United States Patent [19]

Csengeri

[11] 4,290,211

[45] Sep. 22, 1981

[54] VENTILATING OUTSOLE

[76] Inventor: George Csengeri, 5624 Calle de Arboles, Torrance, Calif. 90505

[21] Appl. No.: 84,991

[22] Filed: Oct. 15, 1979

[51] Int. Cl.[3] ..... A43B 7/06

[52] U.S. Cl. ..... 36/3 B

[58] Field of Search ..... 36/3 R, 3 B, 8.1

[56] References Cited

U.S. PATENT DOCUMENTS

| | | | |
|---|---|---|---|
| 3,418,731 | 12/1968 | Anciaux | 36/3 B |
| 3,676,940 | 7/1972 | Shirely | 36/8.1 |
| 4,063,371 | 12/1977 | Batra | 36/3 B |
| 4,100,685 | 7/1978 | Dassler | 36/3 B |
| 4,185,402 | 1/1980 | Digate | 36/3 B |

*Primary Examiner*—Patrick D. Lawson

*Attorney, Agent, or Firm*—Frederick E. Mueller

[57] ABSTRACT

An article of footwear having an improved outsole formed with uniformly distributed small apertures therethrough throughout its area, the apertures being of circular, oval or other curvilinear or angular or polygonal cross-section or any combination of them throughout their axial length and tapering convergently upwardly.

The apertures optimally have diameters, or spans defining equivalent cross-sectional areas, on the order of about 1.6–2 millimeters at their inner ends and 2.4–2.8 millimeters at their outer ends, with center to center spacings on the order of about 5–7 millimeters. Small untapered holes may be employed.

1 Claim, 4 Drawing Figures

VENTILATING OUTSOLE

BACKGROUND

This invention relates to footwear and more particularly to an improved form of ventilating outsole.

It has previously been recognized that it may be desirable to construct articles of footwear incorporating some means for effecting ventilation of the sole of the foot of the wearer. A variety of such constructions have heretofore been patented. Thus, Meaker U.S. Pat. No. 2,558,973 discloses a porous insole overlying a channeled member superimposed over an imperforate outer sole and relying on a kind of valved pumping action to effectuate circulation of air to the sole of the wearer. Shelare et al U.S. Pat. No. 2,884,716 discloses an outsole formed with very large holes and a thick, apertured platform insole. Levine U.S. Pat. No. 3,061,950 discloses an outer sole construction including peripheral or transverse arrays of vent holes, the sole including ground engaging ribs or the like adjacent ones of which have a valving action with respect to corresponding vent openings. McGinnity U.S. Pat. No. 3,383,782 discloses a bootee construction having an outsole with uniformly spaced very large openings all of which are elevated with respect to the ground surface by means of a grid of downwardly protruding ribs.

SUMMARY OF THE INVENTION

In this invention, an article of footwear is provided with an outsole having a multitude of uniformly spaced relatively small apertures therethrough. Preferably the apertures are tapered, of frusto-conical configuration, having relatively small inner ends on the order of about 1.6 to about 2.0 millimeters in diameter and relatively large outer ends on the order of about 2.4 to about 2.8 millimeters in diameter. The above perforations, which may be called channels for thicker soles or for the heel part of the shoe, may have their longitudinal axis vertically, obliquely, in a curved way or elbow-like. Alternatively, the circular holes, or other perforations of other cross sections of similar areas, may be of uniform cylindrical or other configuration but, in either case, whether uniform or tapered in configuration, the center to center spacing of the perforations is maintained on the order of about 5–7 millimeters. A matching perforated insole may be used, having means to index it in position on the outsole. The outsole may be incorporated with any kind of upper and a heel may be incorporated in the sole.

DESCRIPTION OF THE PREFERRED EMBODIMENT

Figure 1:
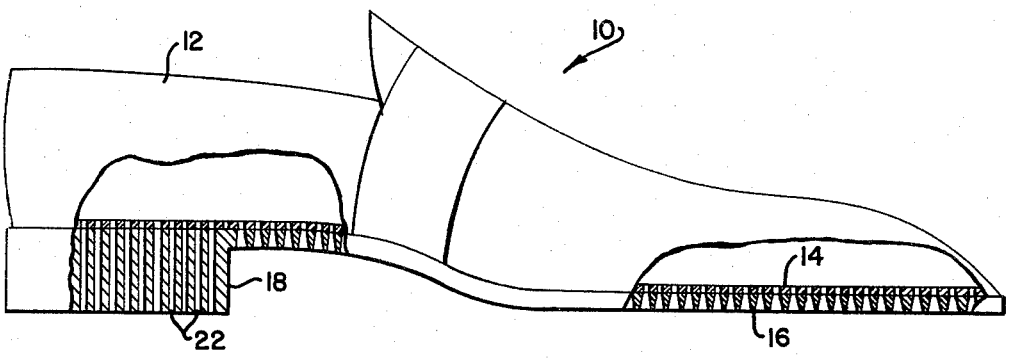
FIG. 1 is a side elevational view of an exemplary shoe embodying the invention, the sole and heel being partly sectioned to reveal the perforated construction.
Figure 2:
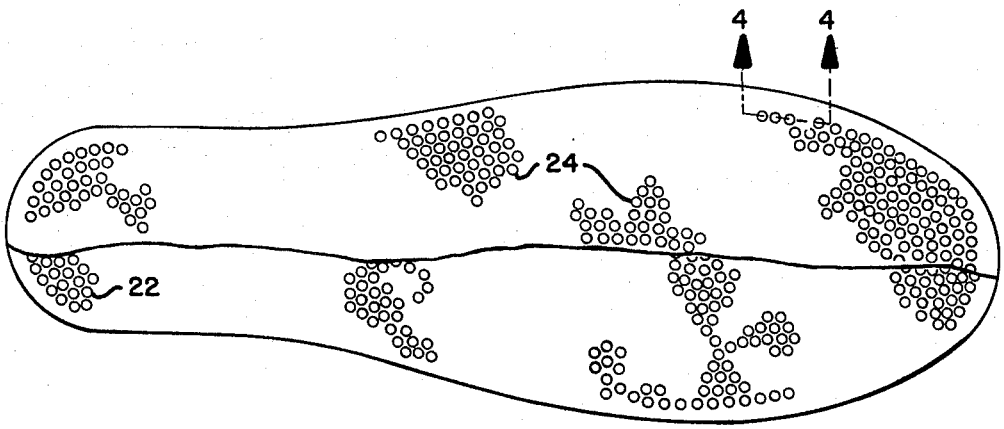
FIG. 2 is a top plan view of an insole and outsole combination, such as may be employed in the shoe of FIG. 1, a portion of the insole being cut away to reveal the upper or inside surface of a portion of the outsole.
Figure 3:
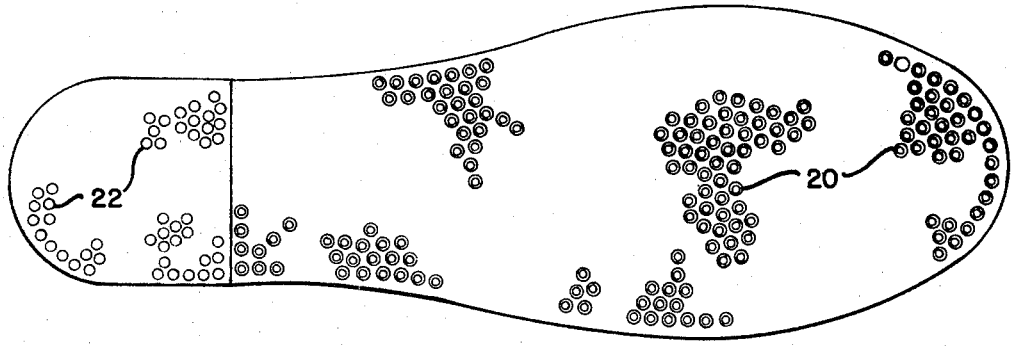
FIG. 3 is a bottom plan view of the outsole of FIG. 2.

Before explaining the invention in detail, it is to be understood that it is not limited in its application to the precise details of construction set forth in the following description or illustrated in the drawings. The invention is capable of other embodiments and of being practiced and carried out in various ways. Also, it is to be understood that the phraseology and terminology employed herein is for the purposes of description and should not be regarded as limiting.

Any desired form of upper may be attached to the sole construction of this invention. However, in FIG. 1, for purposes of illustration, there is depicted a shoe 10 comprising a moccasin-like upper 12, that is marginally secured by conventional means to a sole construction comprising an insole 14 and an outsole 16. The depicted shoe 10 is disclosed as being provided with a heel 18, but it will of course be understood that a heel may be dispensed with, as in the case of a true moccasin or a sandal construction. While the heel 18 is disclosed as being formed integrally with the sole 16 it should further be understood that this constitutes no limitation on the invention and is purely for purposes of illustration.

The outsole 16 is formed with a multiplicity of small bore perforations 20 which are uniformly distributed at least throughout the major area of the sole 16 forwardly of the heel 18. The holes 20 may also be formed throughout the area comprising the heel of the shoe, particularly in such articles as sandals or true moccasins, but for reasons of economy may be dispensed with in shoes having conventional heels.

Figure 4:
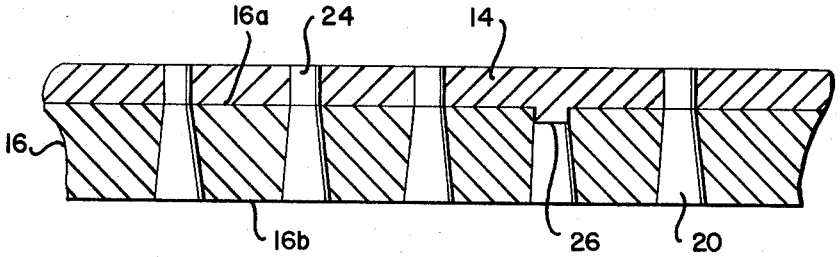
FIG. 4 is a sectional view, on a greatly enlarged scale, of a portion of the insole-outsole combination of FIG. 2, particularly showing a means of indexing a perforated outsole of this invention.

In the illustrated embodiment however, the heel 18 is formed with other small bore perforations 22 which are purely cylindrical, i.e., have uniform diameter throughout their length. On the other hand, the holes 20 in the sole proper are frusto-conical in configuration, i.e., of unequal diameters at inner and outer ends. Thus, referring to FIG. 4, each of the perforations or holes 20 at its inner surface **16*a* has a diameter which is preferably on the order of about 1.60 to about 2.00 millimeters, while each hole at the outer ground engaging surface 16*b* of the outer sole 16 has a diameter on the order of about 2.40 to about 2.80 millimeters. The center to center spacing between the axes of adjacent perforations 20 is preferably on the order of 5 to 7 millimeters and optimally on the order of 6 millimeters. In the case of the holes 22 in the heel portion 18, the hole spacing is also preferably in the range of 5 to 7 millimeters, and the uniformly cylindrical holes 22** have diameters preferably in the range of 1.60 to 2.00 millimeters.

The insole 14, if used, is formed with a plurality of cylindrical perforations 24 of about the same diameter as the inner end diameters of the perforations 20 in the outsole 16, with a hole spacing and arrangement to fall into registration with the holes 20. In order to maintain the insole 14 in the proper registration of its holes 24 with the holes 20 of the outsole 16 an indexing means is provided, which may take the form of integrally formed stubs 26 at spaced locations on the underside of the insole 14 to be matingly received within the holes 20. One or more of the stubs 26 may be provided at various spaced locations such as one or more at each side at the toe end of the shoe, as well as at the heel end and also in the shank portion.

The outsole 16 and the insole 16 may be formed of any suitable shoe material such as leather, rubber, synthetic rubber, or synthetic plastic materials.

The perforated sole 16 will provide ventilation to the foot of the wearer reducing perspiration and burning of the feet. Said ventilation permits exchange of humidity, temperature and air between the inside and outside of the shoe. This will reduce or prevent perspiration, burning of the feet and provide a better and more comfortable environment for the feet than a footwear that does not have the perforations on the sole. It will also be appreciated that by virtue of the presence of the multitude of perforations the sole 16 will feel softer and more pliable. However, in order to achieve optimal, balanced benefits of the invention, the perforations 16 or 22, as the case may be, should be within the prescribed range of about 1.6 to 2.0 millimeters at the inside surface and with the prescribed hole spacing. These very small aperture sizes will not induce sensible discomfort such as would result from engagement between the edge of a relatively sharp edged hole of larger diameter than the prescribed diameter with the skin. I have also found that the tapered configurations of the holes 20 play an important function in reducing obstruction of the holes by small pebbles, rocks, sand, dirt or the like. I have found that with the above parameters, the holes are sufficiently close to each other to provide efficient ventilation without unduly inducing cracking of the sole when it gets worn thin, in the case of leather. The presence of the very great multiplicity of small bore perforations very greatly increases the flexibility and the comfort of the shoe.

I claim:

1. In an article of footwear having an outsole, an insole and some form of upper for maintaining the outsole on the foot, the improvement comprising;

a multiplicity of perforations uniformly distributed throughout a major portion of the ground engaging portion of the outsole through the material of the outsole, to open at the inner surface of the outsole, said perforations having a spacing relative to one another on the order of 5 to 7 millimeters center-to-center and each of said perforations at the inner surface of the outsole having a span on the order of about 1.60 to about 2.00 millimeters, said insole being formed with a plurality of spaced perforations of the same span as said perforations in said outsole, said insole further having a spaced plurality of stubs protruding downwardly from the lower surface of said insole engaging some only of said perforations in said outsole for indexing said insole to said outsole.

* * * * *